US008037619B2

(12) United States Patent
Liu

(10) Patent No.: US 8,037,619 B2
(45) Date of Patent: Oct. 18, 2011

(54) AIR INTAKE STRUCTURE FOR HAND DRYERS OF HIGH AIRFLOW PRESSURE

(75) Inventor: Shen-Chen Liu, Rueifang Township, Taipei County (TW)

(73) Assignee: Hokwang Industries Co., Ltd., Taipei County (TW)

( * ) Notice: Subject to any disclaimer, the term of this patent is extended or adjusted under 35 U.S.C. 154(b) by 0 days.

(21) Appl. No.: 12/430,897

(22) Filed: Apr. 28, 2009

(65) Prior Publication Data

US 2010/0269364 A1 Oct. 28, 2010

(51) Int. Cl.

| | |
|---|---|
| ***F26B 19/00*** | (2006.01) |
| ***F26B 25/06*** | (2006.01) |
| ***F26B 3/02*** | (2006.01) |
| ***F26B 21/04*** | (2006.01) |
| ***A45D 20/12*** | (2006.01) |
| ***A47J 27/00*** | (2006.01) |
| ***A47K 10/48*** | (2006.01) |
| ***F04D 29/44*** | (2006.01) |
| ***F04D 29/54*** | (2006.01) |

(52) U.S. Cl. ..... 34/218; 34/97; 392/380; 392/381; 415/191; 415/192

(58) Field of Classification Search ..... 34/218, 34/215, 210, 283, 96, 97, 201; 392/380, 392/381, 382, 383, 384, 385, 379; 415/191, 415/192

See application file for complete search history.

(56) References Cited

U.S. PATENT DOCUMENTS

| | | | | |
|---|---|---|---|---|
| 3,761,203 | A * | 9/1973 | Neidhardt et al. | 417/371 |
| 7,083,379 | B2 * | 8/2006 | Nikpour et al. | 415/56.5 |
| 2007/0059161 | A1 * | 3/2007 | Bouru | 415/160 |

FOREIGN PATENT DOCUMENTS

| | | | |
|---|---|---|---|
| JP | 60 013998 | A * | 1/1985 |
| JP | 60 073096 | A * | 4/1985 |
| JP | 08196470 | A * | 8/1996 |
| JP | 09 238866 | A * | 9/1997 |

* cited by examiner

*Primary Examiner* — Kenneth B Rinehart
*Assistant Examiner* — Corey J Hall
(74) *Attorney, Agent, or Firm* — Muncy, Geissler, Olds & Lowe, PLLC

(57) ABSTRACT

An air intake structure is located on an airflow guiding casing of a hand dryer communicating with gaps formed between motor blades in the airflow guiding casing. It includes a flow directing frame located on the airflow guiding casing, an axle located in the center of the flow directing frame and a plurality of flow directing blades located between the flow directing frame and the axle.

2 Claims, 6 Drawing Sheets

AIR INTAKE STRUCTURE FOR HAND DRYERS OF HIGH AIRFLOW PRESSURE

FIELD OF THE INVENTION

The present invention relates to an air intake structure for hand dryers of high airflow pressure to provide an air inlet structure for a hand dryer.

BACKGROUND OF THE INVENTION

These days people have increasingly high expectation on life quality. As a result, they also have a higher hygienic demand in daily activities and facilities, notably public toilet facilities. In the past, many public toilet facilities have to be manually operated with hands. Now, many of them are operable automatically by detecting user's use conditions through sensors. Hence in the past users have to shake hands after washing and result in spraying water around, then an improvement was made by providing retrievable paper towels for wiping hands. These days environmental protection awareness increases gradually and protection of trees becomes an increasing focus. Thus the paper towels are gradually displaced by hand dryers.

There are numerous types of hand dryers on the market. They mainly adopt a principle of using a motor to rotate blades to suck in air, heat the air and deliver the heated air. Namely the whole operation includes three elements of "air intake", "heating" and "air delivery". To dry the hands within a short time period with reasonable power consumption, every producer tries to alter and adjust the aforesaid three elements. For instance, to save energy consumption in the "heating" element, the heating temperature is lowered but the power for "air delivery" could increase to blow the hands with a greater airflow speed to dispel water from the hands. Some hand dryers attempt to increase the "heating" temperature but reduce the power of "air delivery" to dry the hands. Some other hand dryers focus on design of "air intake" location to recycle the heated air and save energy. However, trying to achieve an effective balance of the three elements of "air intake", "heating" and "air delivery" remains the core technique of all types of hand dryers. As energy saving is a prevailing trend now, to meet this end design has gradually shifted to delivering high pressure airflow to reduce electric power consumption in the "heating" step. Thus drying hands with high pressure airflow becomes an increasing focus in the design of hand dryers at present.

While designing the hand dryer with a high airflow pressure to save electric power is the prevailing trend at present, it also creates noise problem. The biggest sources of the noise are vibration and airflow shearing caused by the air inlet structure. The conventional air inlet structure adopts a mesh type or shutter type structure to avoid sucking in external articles and prevent incidental intrusion of user's hands.

To reduce the airflow shearing at the air inlet, some hand dryers provide a longer air passage between the air inlet and motor blades to inhibit noise generation. Such an approach greatly increases the size of the hand dryer. The position of the air inlet is restricted and motor air intake efficiency also suffers, that result in even more shortcomings. Hence trying to make structural change to reduce the noise is not a desirable approach. The present hand dryers of high airflow pressure mostly have the air inlet close to the motor blades to increase air intake efficiency. There is no effective way to reduce the noise. The noise problem still exists to date. To provide an air intake structure that can inhibit noise in the condition of a shorter distance between the air inlet and motor is still an issue remained to be resolved.

SUMMARY OF THE INVENTION

In view of the conventional hand dryers of high airflow pressure that cannot effectively reduce the noise generated at the air inlet, the primary object of the present invention is to provide an air intake structure for hand dryers of high airflow pressure to inhibit noise in a condition of having an air inlet located close to a motor.

To achieve the foregoing object, the air intake structure according to the invention is located on an airflow guiding casing of a hand dryer communicating with gaps formed between motor blades of a motor and a motor air suction port formed in the airflow guiding casing.

It includes a circular flow directing frame formed with an arched profile and protruded from the airflow guiding casing to form an air inlet communicating with the motor air suction port and a flow directing chamber formed between one surface end of the air inlet and an outmost surface end of the flow directing frame, an axle formed with a curved profile and located in the center of the flow directing chamber, and a plurality of flow directing blades extended from the axle to connect to the flow directing frame and formed with the same curved direction to direct airflow and a curved edge on the rims thereof. The curved direction of the flow directing blades is opposite to the curved direction of the motor blades.

By means of the construction set forth above, the invention can provide at least the following advantages:

1. With the flow directing blades and the motor blades formed in opposite directions, a contra-rotating propellers (CRP) structure is formed so that the airflow sucked in by the motor is converged at a greater degree and air intake efficiency improves. Such a structure also can inhibit noise generated by airflow scattering.

2. The flow directing frame, axle and rim edges of the flow directing blades are formed with the curved profiles, airflow shearing noise that might otherwise occur due to sharp edges of the air intake structure can be reduced.

3. By providing the aforesaid two types of noise inhibiting structures, design of the hand dryer of high airflow pressure is not restricted by the location of the air intake structure. The air intake structure can be located on the hand dryer wherever desired, or close to the motor. Thus the hand dryer can be made smaller and also to inhibit noise generation at the same time.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
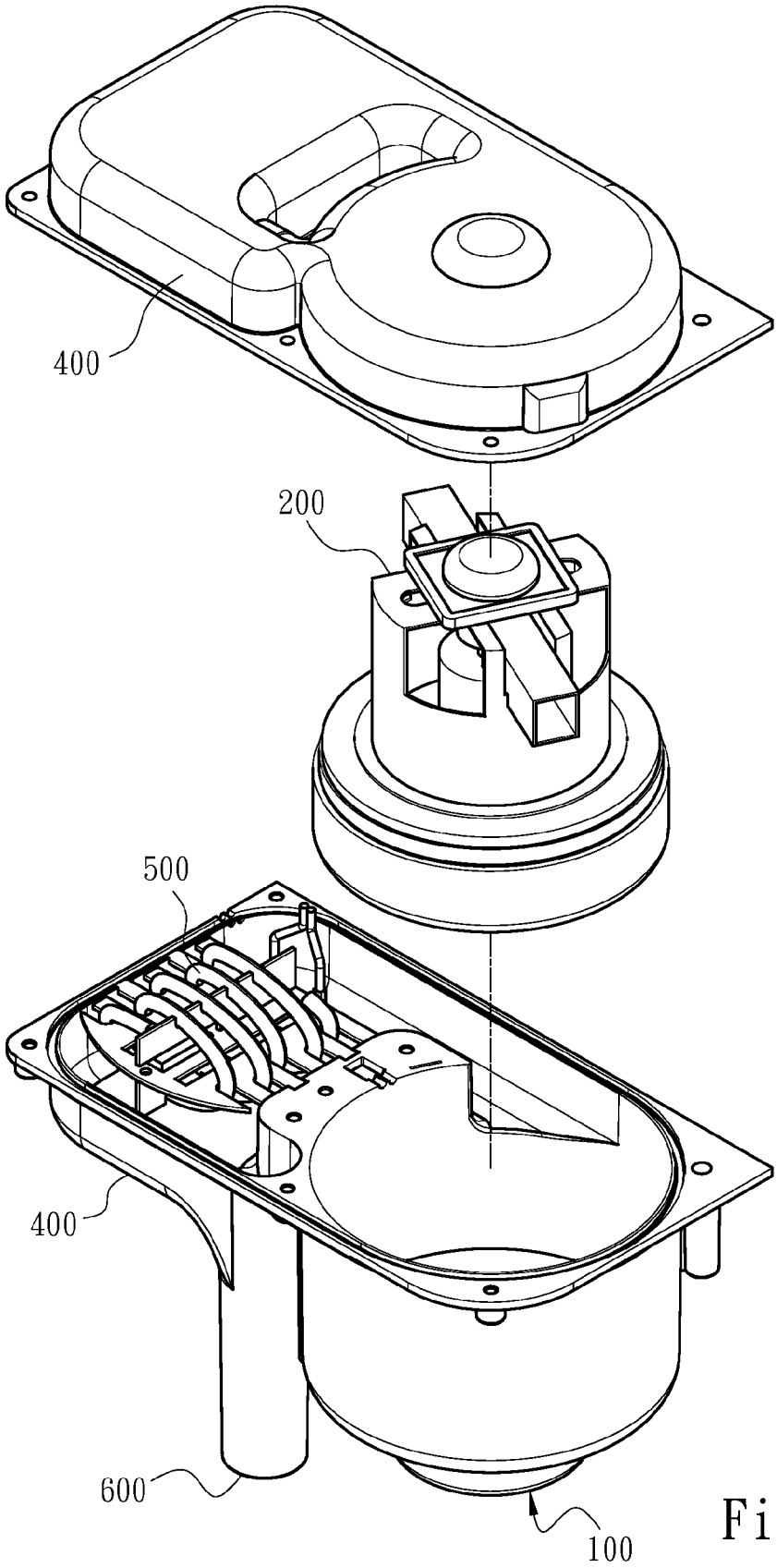
FIG. 1 is a top exploded view of the invention.
Figure 2:
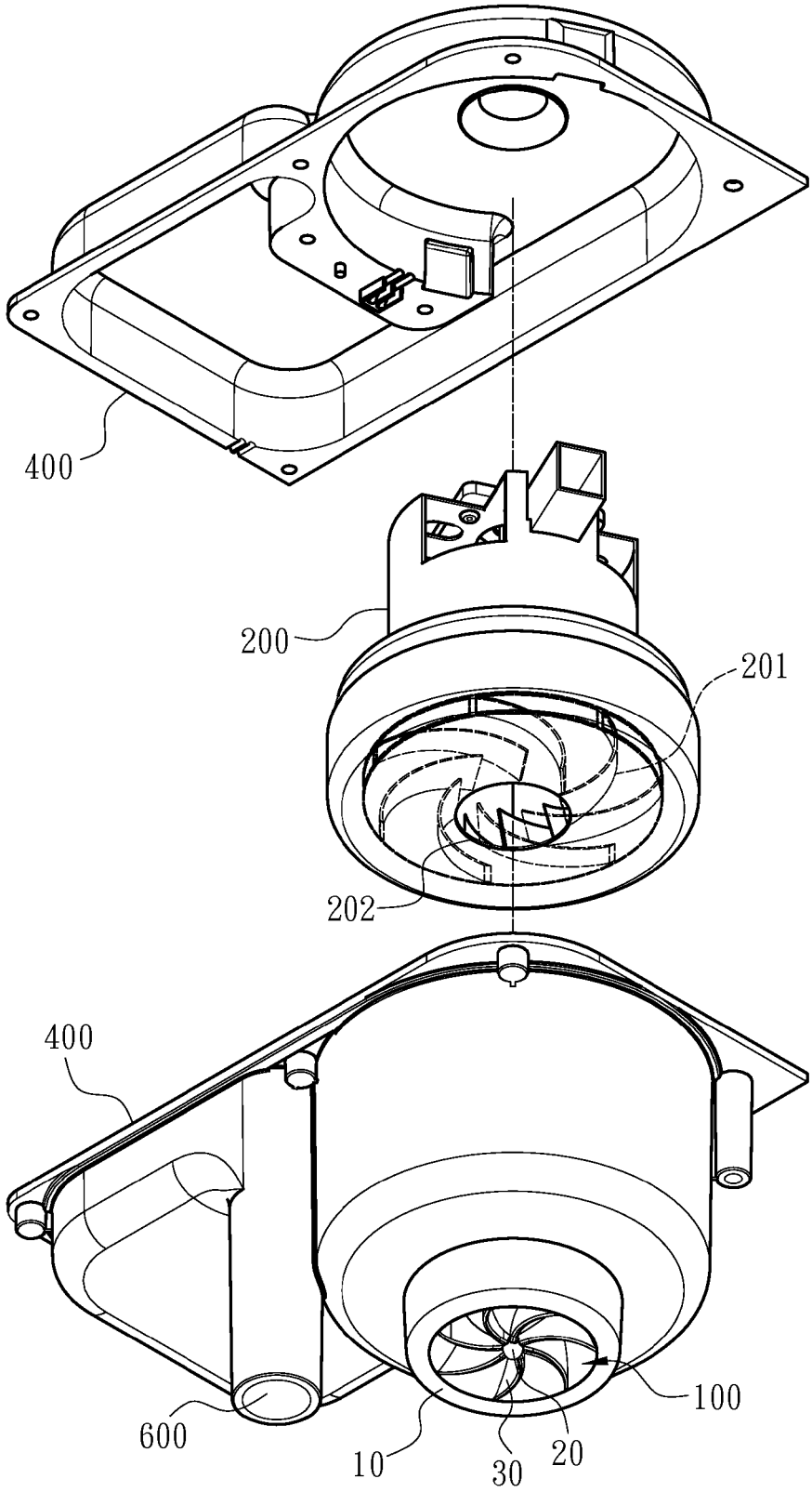
FIG. 2 is a bottom exploded view of the invention.

The present invention provides an air intake structure for hand dryers of high airflow pressure. Please refer to FIGS. 1 and 2, the air intake structure 100 according to the invention is located on an airflow guiding casing 400 of a hand dryer communicating with gaps formed between motor blades 201 of a motor 200 and a motor air suction port 202 located in the air guiding casing 400. When the motor blades 201 rotate, airflow is sucked in through the air intake structure 100 and the motor air suction port 202. The motor blades 201 provide airflow energy, so that the airflow passes through a heater 500 and is delivered through an air outlet 600, thus forms the basic structure of the hand dryer.

Figure 3:
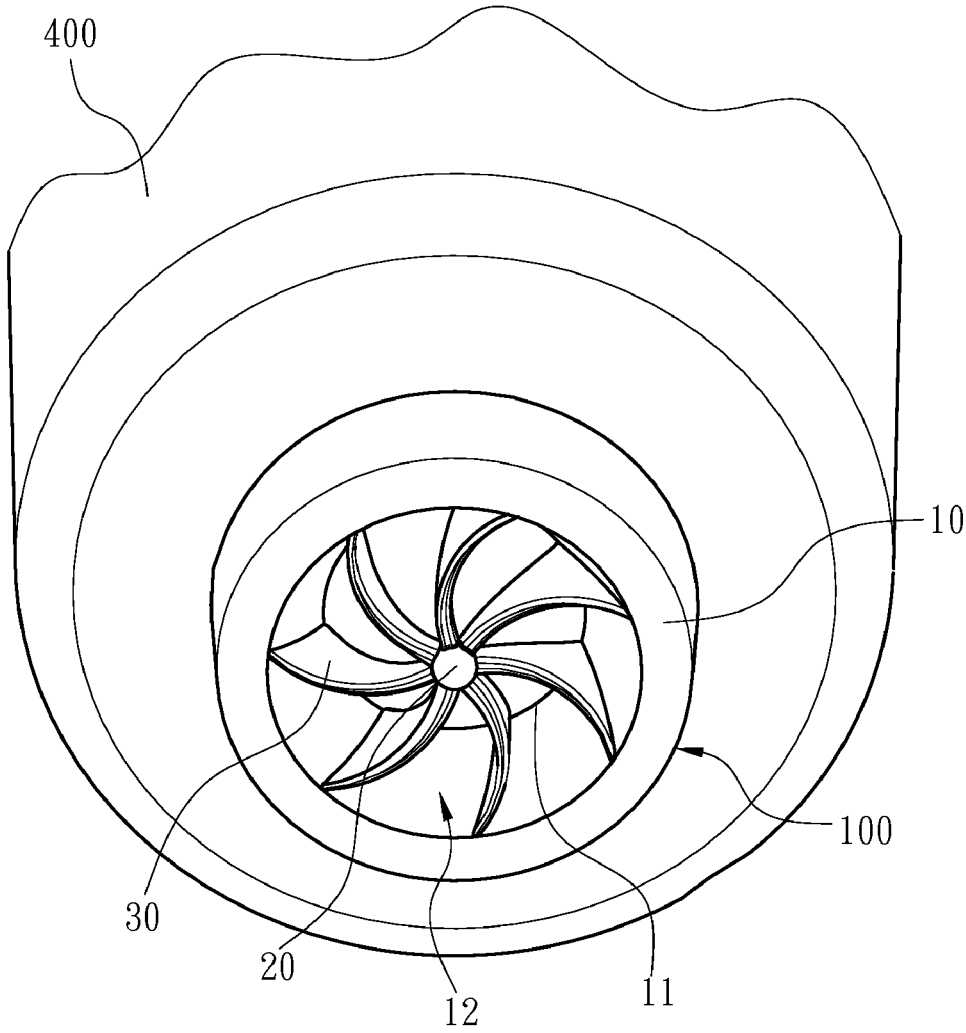
FIG. 3 is a fragmentary enlarged view of the air intake structure of the invention.
Figure 4A:
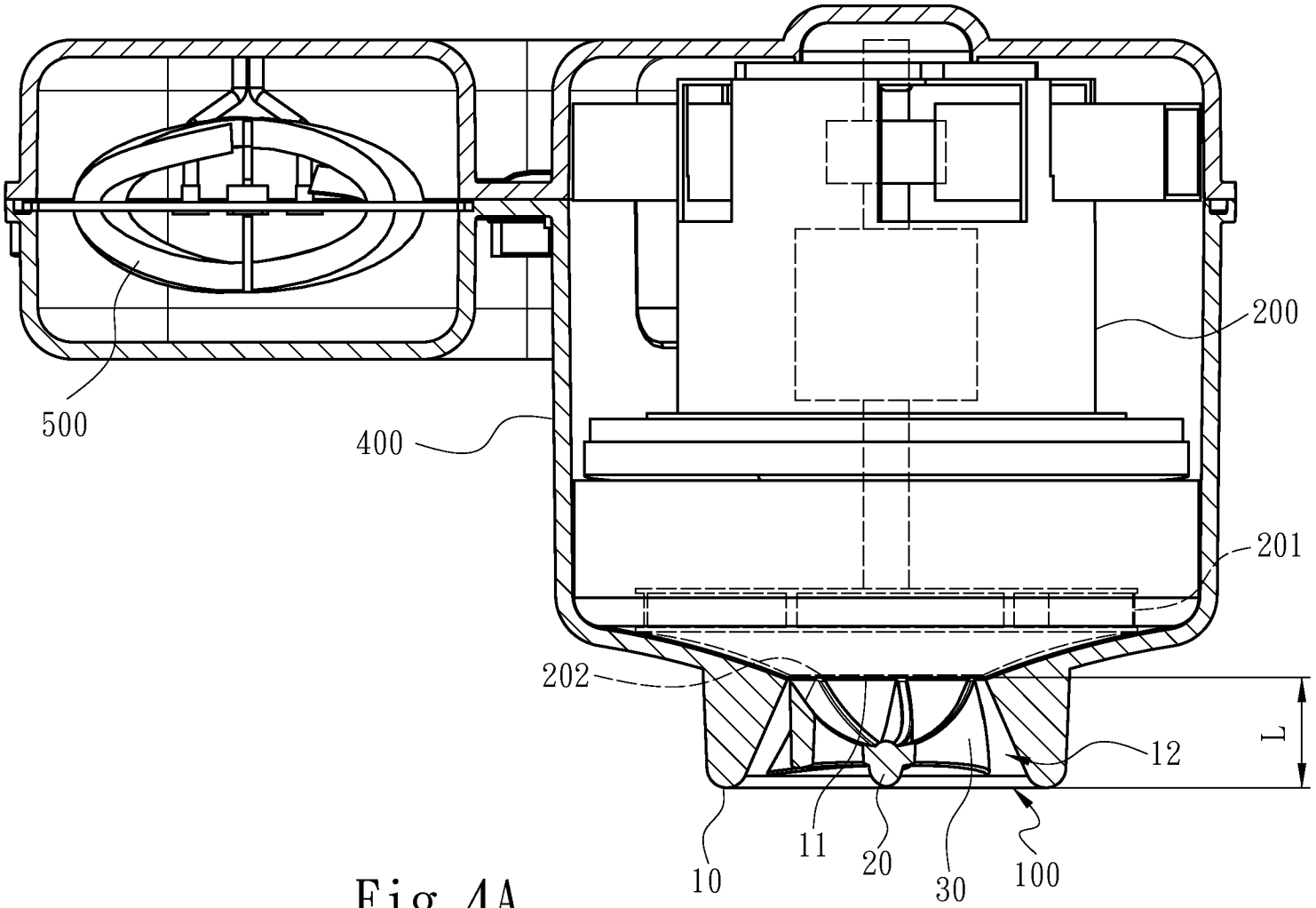
FIG. 4A is a sectional view of the invention.
Figure 4B:
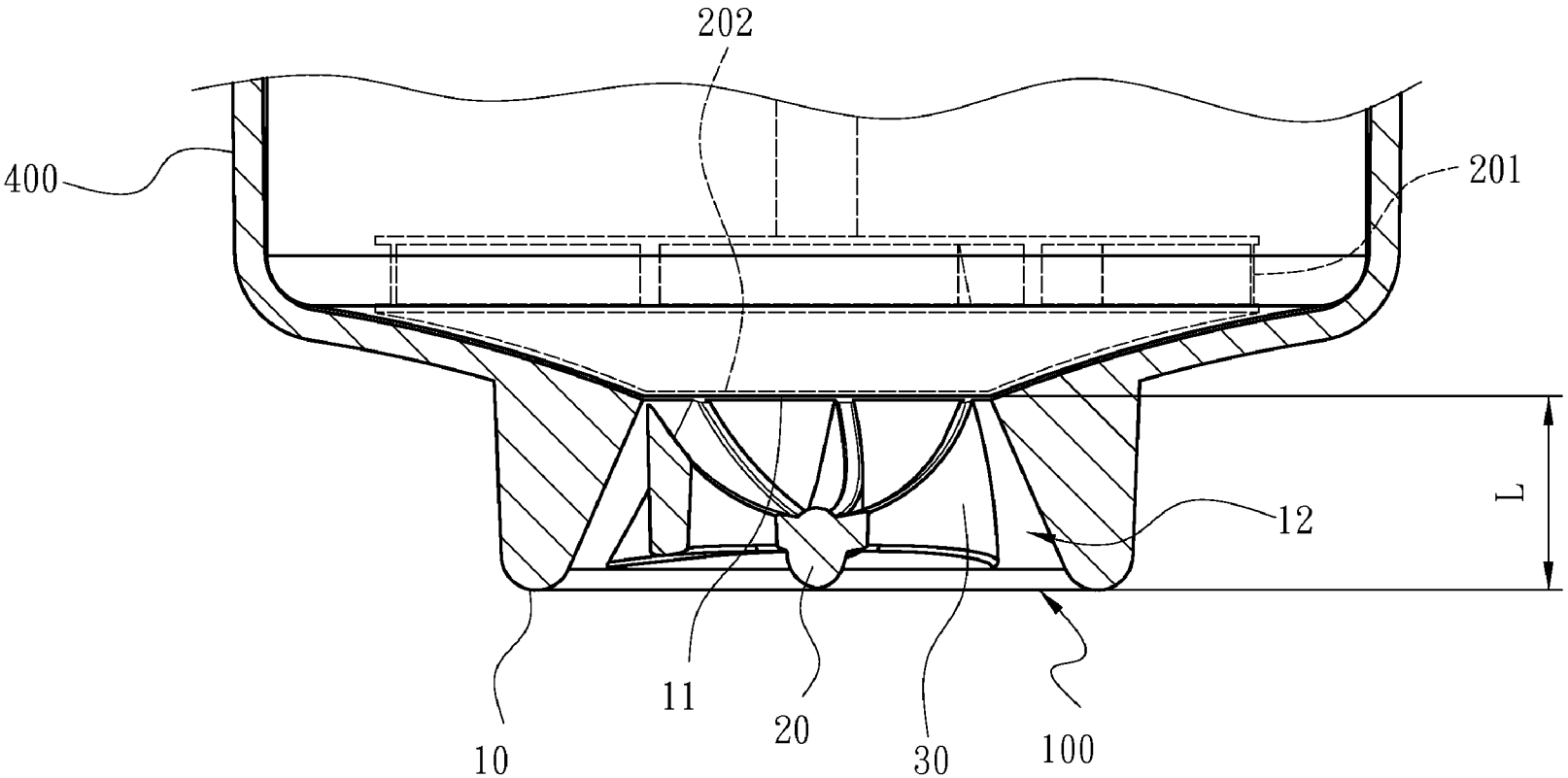
FIG. 4B is a sectional fragmentary enlarged view of the invention.
Figure 5:
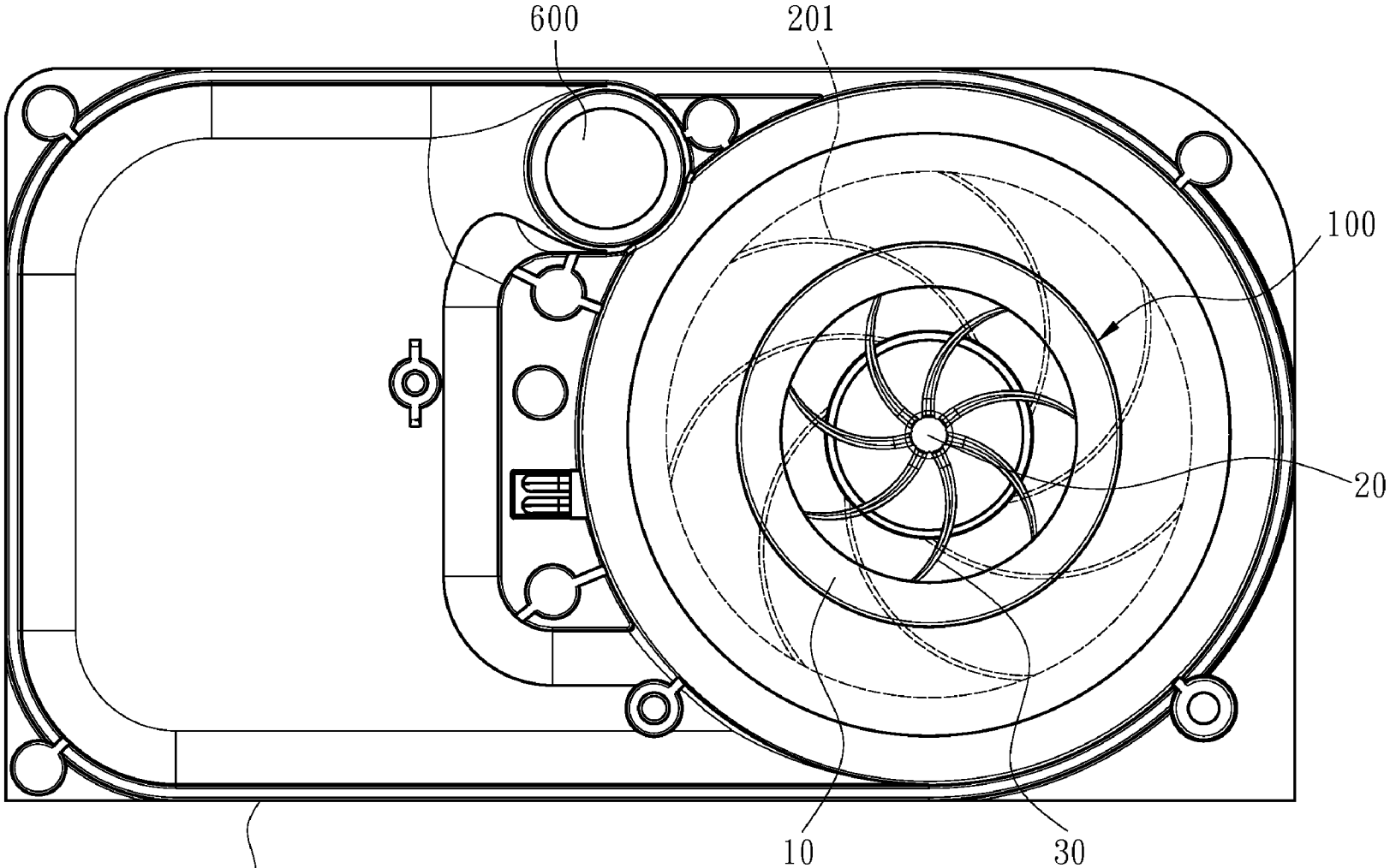
FIG. 5 is a fragmentary bottom view of the invention.

Also referring to FIG. 3, the air intake structure 100 includes a flow directing frame 10, an axle 20 and a plurality of flow directing blades 30. The flow directing frame 10 is circular and has an arched profile protruded from the air guiding casing 400. When the airflow is sucked in, the circular profile of the flow directing frame 10 can inhibit airflow shearing and prevent noise generation. The flow directing frame 10 has an outmost surface end to form a flow directing chamber 12 with one surface end of an air inlet 11 which communicates with the motor air suction port 202. The axle 20 is located in the center of the flow directing chamber 12. The axle 20 also has a curved profile to avoid generating airflow shearing noise. The axle 20 is extended from the flow directing blades 30 connecting to the flow directing frame 10. The flow directing blades 30 are formed at the same curving direction. As shown in an embodiment depicted in the drawings, the flow directing blades 30 are curved in the clockwise direction and connected to the flow directing frame 10. However, it is not the limitation of the invention. The flow directing blades 30 may also be curved in the counterclockwise direction and connected to the flow directing frame 10. They are formed to direct airflow direction. Each of the flow directing blades 30 has a first curved edge on its top rim and a second curved edge on its bottom rim, shown in FIGS. 4A and 4B. Referring to FIG. 5, the flow directing blades 30 are curved in an opposite direction of the motor blades 201. In the embodiment shown in the drawings, the flow directing blades 30 are curved in the clockwise direction, while the motor blades 201 are curved in the counterclockwise direction. On the other hand, the flow directing blades 30 may also be curved in the counterclockwise direction, while the motor blades 201 curved in the clockwise direction. They form in contra-rotating propellers (CRP) structure. Such a structure allows the air intake structure 100 to suck in airflow in a converged fashion and can enhance air intake efficiency of the high pressure hand dryer. The airflow converging also can inhibit noise generated by airflow scattering that might otherwise occur.

By means of the structure of the air intake structure 100 previously discussed, noise generation can be reduced. The invention can be adopted on various types of hand dryers, and is especially desirable to the hand dryers of high airflow pressure that require the air intake structure 100 close to the motor blades 201. Refer to FIGS. 4A and 4B for an embodiment of the invention. The air intake structure 100 is located close to the motor blades 201. The motor air suction port 202 and the outmost surface end of the flow directing frame 10 are spaced at a distance between 1 and 4 cm, namely formed a flow passage at a length of L between 1 and 4 cm. Hence the air intake structure 100 can be located closer to the motor blades 201. Such a structure can enhance air intake efficiency and more suitable for fast air intake of the hand dryer of high airflow pressure. The size of the product can be shrunk and noise can be inhibited.

Referring to FIG. 3, the flow directing blades 30 are formed with a cross section at a thickness gradually thinner from the axle 20 towards the flow directing frame 10. The flow directing blades 30 has one end connecting to the axle 20 that is formed at a cross section thicker than another end thereof connecting to the flow directing frame 10. Furthermore, in order to make airflow resistance of the air intake structure 100 smaller, the circumferential length of the axle 20 is the sum of total thickness of the cross section of one end of the flow directing blades 30 connecting to the axle 20. The air intake structure 100 thus formed is more desirable for the hand dryers of high airflow pressure.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. An air intake structure for hand dryers of high airflow pressure located on an airflow guiding casing of a hand dryer communicating with gaps formed between motor blades of a motor and a motor air suction port located in the airflow guiding casing, comprising:

a flow directing frame which is circular and has an arched profile protruded from the airflow guiding casing and an air inlet communicating with the motor air suction port, and a flow directing chamber formed between one surface end of the air inlet and an outmost surface end of the flow directing frame;

an axle which has a curved profile and is located in the center of the flow directing chamber; and a plurality of flow directing blades which are extended from the axle and connected to the flow directing frame and are curved in a same direction to direct airflow and each of which has a first curved edge formed on its top rim and a second curved edge formed on its bottom rim, the curved direction of the flow directing blades extended from the axle and connected to the flow directing frame being opposite to another curved direction of the motor blades;

wherein the air intake structure is located close to the motor blades so that the motor air suction port and the outmost surface end of the flow directing frame are spaced at a distance between one and four centimeters;

wherein the flow directing blades are formed with a cross section at a thickness gradually thinner from the axle towards the flow directing frame such that one end of the flow directing blades connecting to the axle is formed at a cross section thicker than another end of the flow directing blades connecting to the flow directing frame.

2. The air intake structure of claim 1, wherein the axle has a circumferential length equal to the sum of the cross section thickness of one end of the flow directing blades connecting to the axle.

* * * * *